US009242147B2

(12) United States Patent
Onuki

(10) Patent No.: US 9,242,147 B2
(45) Date of Patent: Jan. 26, 2016

(54) GOLF BALL

(75) Inventor: Masahide Onuki, Kobe (JP)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 331 days.

(21) Appl. No.: 13/612,018

(22) Filed: Sep. 12, 2012

(65) Prior Publication Data

US 2013/0109507 A1 May 2, 2013

(30) Foreign Application Priority Data

Oct. 28, 2011 (JP) ..... 2011-237011

(51) Int. Cl.
*A63B 37/04* (2006.01)
*A63B 37/06* (2006.01)
*A63B 37/00* (2006.01)

(52) U.S. Cl.
CPC ..... *A63B 37/0003* (2013.01); *A63B 37/0035* (2013.01); *A63B 37/0047* (2013.01); *A63B 37/0063* (2013.01); *A63B 37/0074* (2013.01); *A63B 37/0075* (2013.01); *A63B 37/0076* (2013.01); *A63B 37/0091* (2013.01); *A63B 37/0037* (2013.01); *A63B 37/0083* (2013.01)

(58) Field of Classification Search
USPC ..... 473/351–378
See application file for complete search history.

(56) References Cited

U.S. PATENT DOCUMENTS 5,984,806 A * 11/1999 Sullivan et al. ..... 473/373
6,048,279 A * 4/2000 Masutani ..... 473/372
6,315,681 B1 * 11/2001 Sullivan ..... 473/373
6,494,795 B2 12/2002 Sullivan
6,533,682 B2 3/2003 Sullivan
6,595,874 B2 * 7/2003 Sullivan et al. ..... 473/374
6,743,123 B2 * 6/2004 Sullivan ..... 473/376
6,786,838 B2 9/2004 Sullivan et al.
6,902,498 B2 * 6/2005 Sullivan et al. ..... 473/374
6,908,402 B2 * 6/2005 Sullivan et al. ..... 473/376
6,945,878 B2 * 9/2005 Binette et al. ..... 473/373
6,991,563 B2 * 1/2006 Sullivan et al. ..... 473/374
7,232,384 B2 * 6/2007 Sullivan et al. ..... 473/373
7,388,053 B2 * 6/2008 Sullivan et al. ..... 525/274
8,562,460 B2 * 10/2013 Sullivan et al. ..... 473/376
2011/0160001 A1 6/2011 Nanba et al.
2011/0207554 A1 8/2011 Nanba et al.
2011/0207555 A1 8/2011 Nanba et al.

FOREIGN PATENT DOCUMENTS

JP 11-89969 A 4/1999
JP 2009-160018 A 7/2009
JP 2011-136162 A 7/2011

* cited by examiner

*Primary Examiner* — Alvin Hunter

(74) *Attorney, Agent, or Firm* — Birch Stewart Kolasch & Birch, LLP

(57) ABSTRACT

A golf ball has a non-uniform density. When the golf ball is divided into 10 layers whose volumes are the same and which are concentric with each other, a layer having the highest weight is any one of six layers including a first layer 28 from a center to a sixth layer 38 from the center. The layer having the highest weight may be two or more layers. The ratio of the distance between a point at which a local density is highest and the central point of the golf ball with respect to the radius of the golf ball is equal to or less than 85%.

8 Claims, 8 Drawing Sheets

GOLF BALL

This application claims priority on Patent Application No. 2011-237011 filed in JAPAN on Oct. 28, 2011. The entire contents of this Japanese Patent Application are hereby incorporated by reference.

BACKGROUND OF THE INVENTION

1. Field of the Invention

The present invention relates to golf balls. Specifically, the present invention relates to improvement of density distributions of golf balls.

2. Description of the Related Art

A golf ball hit with a golf club flies out with a launch angle relative to the horizontal direction. The launch angle is caused by the fact that the head of the golf club has a loft angle. At the time of flying out, the golf ball has so-called backspin. The backspin is caused by a shear force generated when the golf ball collides against the head having the loft angle.

The shear force is applied to the surface of the golf ball. Since the golf ball is an elastic body, even when the shear force is applied to the surface, the center of the golf ball attempts to remain still due to a moment of inertia. Therefore, due to the shear force, the time at which rotation of the center of the golf ball begins is slightly delayed with respect to the time at which rotation of the surface of the golf ball begins. Due to this delay, torsional strain occurs within the golf ball. When the torsional strain is eliminated, a negative shear force is applied to the golf ball. The direction of the negative shear force is a direction in which overspin is provided to the golf ball. At the time of impact, a positive shear force and a negative shear force are applied to the golf ball. In a correctly-hit golf ball, the positive shear force is greater than the negative shear force. The negative shear force does not exceed the positive shear force. Therefore, to the correctly-hit golf ball, backspin is provided, not overspin.

The trajectory of a golf ball after launch is greatly influenced by the launch angle and the backspin rate. A golf ball having a high launch angle tends to have a high trajectory. On the other hand, a golf ball having a low launch angle tends to have a low trajectory. By backspin, a lift force is generated in a golf ball. A golf ball having high backspin tends to have a high trajectory. A golf ball having low backspin tends to have a low trajectory.

Golf players' foremost requirement for golf balls is flight distance. In particular, golf players place importance on flight distances upon shots with a driver and a long iron. In order to achieve a large flight distance, an appropriate trajectory height is required.

In a golf ball that achieves a high trajectory by a high spin rate, a flight distance is insufficient. One of the reasons is inferred to be that the higher the spin rate is, the greater the drag is generated. Another reason is inferred to be that a lift force is applied perpendicularly to the flying direction and thus a force to pull the golf ball backwards is generated by the lift force until the highest point of the trajectory.

Meanwhile, in a golf ball that achieves a high trajectory by a high launch angle, a large flight distance is obtained. A golf ball is desired which has a low backspin rate and a high launch angle when being hit with a driver or a long iron.

Golf players also place importance on spin performance of golf balls. When a backspin rate is high, the run is short. It is easy for golf players to cause a golf ball, to which backspin is easily provided, to stop at a target point. When a sidespin rate is high, the golf ball easily curves. It is easy for golf players to intentionally cause a golf ball, to which sidespin is easily provided, to curve. A golf ball to which spin is easily provided has excellent controllability. In particular, advanced golf players place importance on controllability upon a shot with a short iron.

There have been various proposals for the density distributions of golf balls. JP2002-331047 (U.S. Pat. No. 6,533,682) discloses: a golf ball that includes a high-specific-gravity core, a low-specific-gravity mantle layer positioned outside the core, and a low-specific-gravity cover positioned outside the mantle layer; and a golf ball that includes a low-specific-gravity core, a high-specific-gravity mantle layer positioned outside the core, and a cover positioned outside the mantle layer. Similar golf balls are also disclosed in JP2002-325863 (U.S. Pat. No. 6,494,795), JP2005-111246 (U.S. Pat. No. 6,786,838), and JP2008-6302. Any of these publications discloses a technique to adjust the moment of inertia of the golf ball. For example, paragraph [0007] of JP 2002-325863 states that "Specifically, if the density of the ball is shifted or distributed toward the center of the ball, the moment of inertia is reduced, and the initial spin rate of the ball as it leaves the golf club would increase due to the lower resistance from the ball's moment of inertia. Conversely, if the density is shifted or distributed toward the outer cover, the moment of inertia is increased, and the initial spin rate of the ball as it leaves the golf club would decrease due to the higher resistance from the ball's moment of inertia." This publication states that if the density of the ball is shifted toward the center of the ball, the moment of inertia is reduced and the initial spin increases. JP2002-331047 has a similar description at paragraph [0008] but has a misdescription regarding increase/decrease of spin.

JP2011-172929 (U.S.2011/0207555) discloses a golf ball that includes a core, a mid layer, a cover, and a high-specific-gravity member. The high-specific-gravity member contributes to adjustment of the moment of inertia of the golf ball. A similar golf ball is also disclosed in JP2011-172930 (U.S.2011/0207554).

JP11-89969 discloses a golf ball that includes high-weight grains or ring. The grains or ring contributes to adjustment of the moment of inertia of the golf ball.

JP2009-160018 discloses a method of designing a golf ball. In this method, a golf ball whose elastic modulus distribution is made appropriate is obtained.

There have been also various proposals for the hardness distributions of golf balls. A golf ball having an outer-hard/inner-soft structure is commercially available. In the golf ball, the negative shear force is great. When the golf ball is hit, the golf ball flies with a high launch angle and a low spin rate. When the golf ball is hit with a long iron, a large flight distance is obtained.

As described above, a golf ball having an outer-hard/inner-soft structure has excellent flight performance. However, golf players desire further improvement of flight distance. An excessive hardness gradient impairs the durability of the golf ball. It is impossible to meet the golf player's requirement for flight distance only by an outer-hard/inner-soft structure.

When a golf ball having an outer-hard/inner-soft structure is hit with a short iron, the golf ball largely slips relative to the face of the golf club since the outer portion of the golf ball is hard. By this slip, spin is suppressed. The golf ball has inferior controllability upon a shot with a short iron.

An objective of the present invention is to provide a golf ball having excellent flight performance when being hit with a long iron and having excellent controllability when being hit with a short iron.

SUMMARY OF THE INVENTION

The inventor of the present invention has found that when the density of a golf ball is shifted toward the center of the golf ball, the initial spin may be reduced, thereby leading to completion of the present invention. The reason why the initial spin is reduced is thought to be that torsional strain occurs within the golf ball at the time of impact.

A golf ball according to the present invention has a non-uniform density. In the golf ball, a ratio of a distance between a point at which a local density is highest and a central point with respect to a radius of the golf ball is equal to or less than 85%. Preferably, the ratio is equal to or greater than 25% but equal to or less than 75%.

When the golf ball is divided into m (m is an even number equal to or higher than 2) layers whose volumes are the same and which are concentric with each other, a layer having a highest weight is one or more layers among layers including a first layer from a center to a (m/2+1)th layer from the center. Preferably, the layer having the highest weight is any one layer among the layers including the first layer from the center to the (m/2+1)th layer from the center. More preferably, the layer having the highest weight is any one layer among layers including the first layer from the center to a (m/2)th layer from the center.

When the golf ball is divided into n (n is an odd number equal to or higher than 3) layers whose volumes are the same and which are concentric with each other, a layer having a highest weight is one or more layers among layers including a first layer from a center to a (n/2+0.5)th layer from the center. Preferably, the layer having the highest weight is any one layer among the layers including the first layer from the center to the (n/2+0.5)th layer from the center. More preferably, the layer having the highest weight is any one layer among layers including the first layer from the center to a (n/2−0.5)th layer from the center.

Preferably, the layer having the highest weight is one or more layers among layers including a second layer from the center to a fourth layer from the center.

In the golf ball according to the present invention, the weight is biased toward the center. When the golf ball is hit with a long iron, the spin rate is low. When the golf ball is hit with a long iron, a large flight distance is obtained. When the golf ball is hit with a short iron, the spin rate is high. When the golf ball is hit with a short iron, excellent controllability is achieved.

DESCRIPTION OF THE PREFERRED EMBODIMENTS

The following will describe in detail the present invention, based on preferred embodiments with reference to the accompanying drawings.

Figure 1:
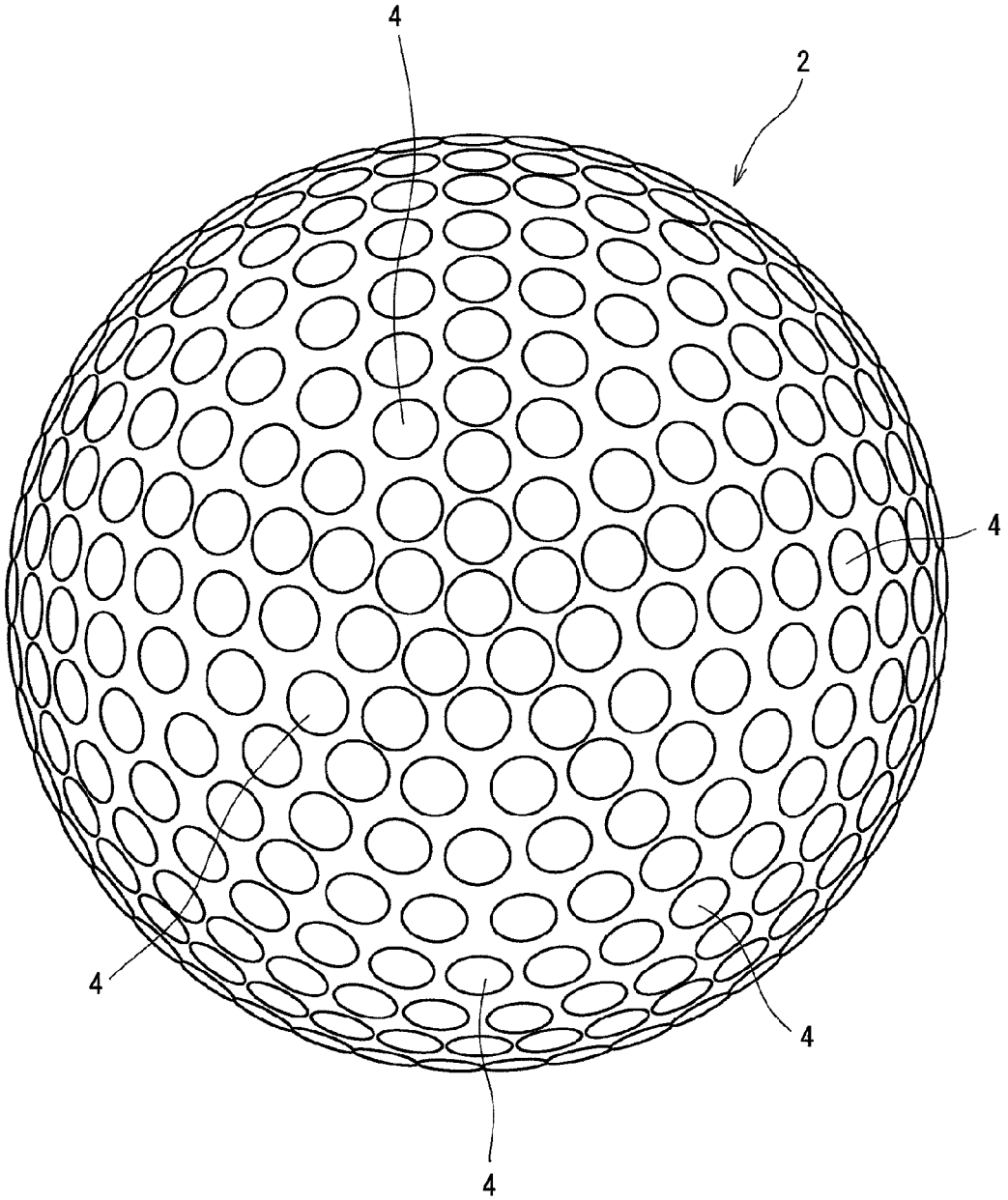
FIG. 1 is a front view of a golf ball according to one embodiment of the present invention.

A golf ball 2 shown in FIG. 1 has a large number of dimples 4 on a surface thereof. The golf ball 2 has a diameter of 40 mm or greater but 45 mm or less. From the standpoint of conformity to the rules established by the United States Golf Association (USGA), the diameter is preferably equal to or greater than 42.67 mm. In light of suppression of air resistance, the diameter is preferably equal to or less than 44 mm and particularly preferably equal to or less than 42.80 mm. The golf ball 2 has a weight of 40 g or greater but 50 g or less. In light of attainment of great inertia, the weight is preferably equal to or greater than 44 g and particularly preferably equal to or greater than 45.00 g. From the standpoint of conformity to the rules established by the USGA, the weight is preferably equal to or less than 45.93 g.

In the golf ball 2, various structures can be used. In the golf ball 2, a two-layer structure composed of a core and a cover may be used. In the golf ball 2, a three-layer structure composed of a core, a mid layer, and a cover may be used. In the golf ball 2, a four-layer structure composed of a core, an envelope layer, a mid layer, and a cover may be used. The golf ball 2 may include five or more layers.

According to the finding by the inventor of the present invention, not only the hardness distribution of the golf ball 2 but also the density distribution of the golf ball 2 influence spin performance. This finding is obtained by simulation in which a model of the golf ball 2 is used. The simulation method used is the finite element method.

Figure 2:
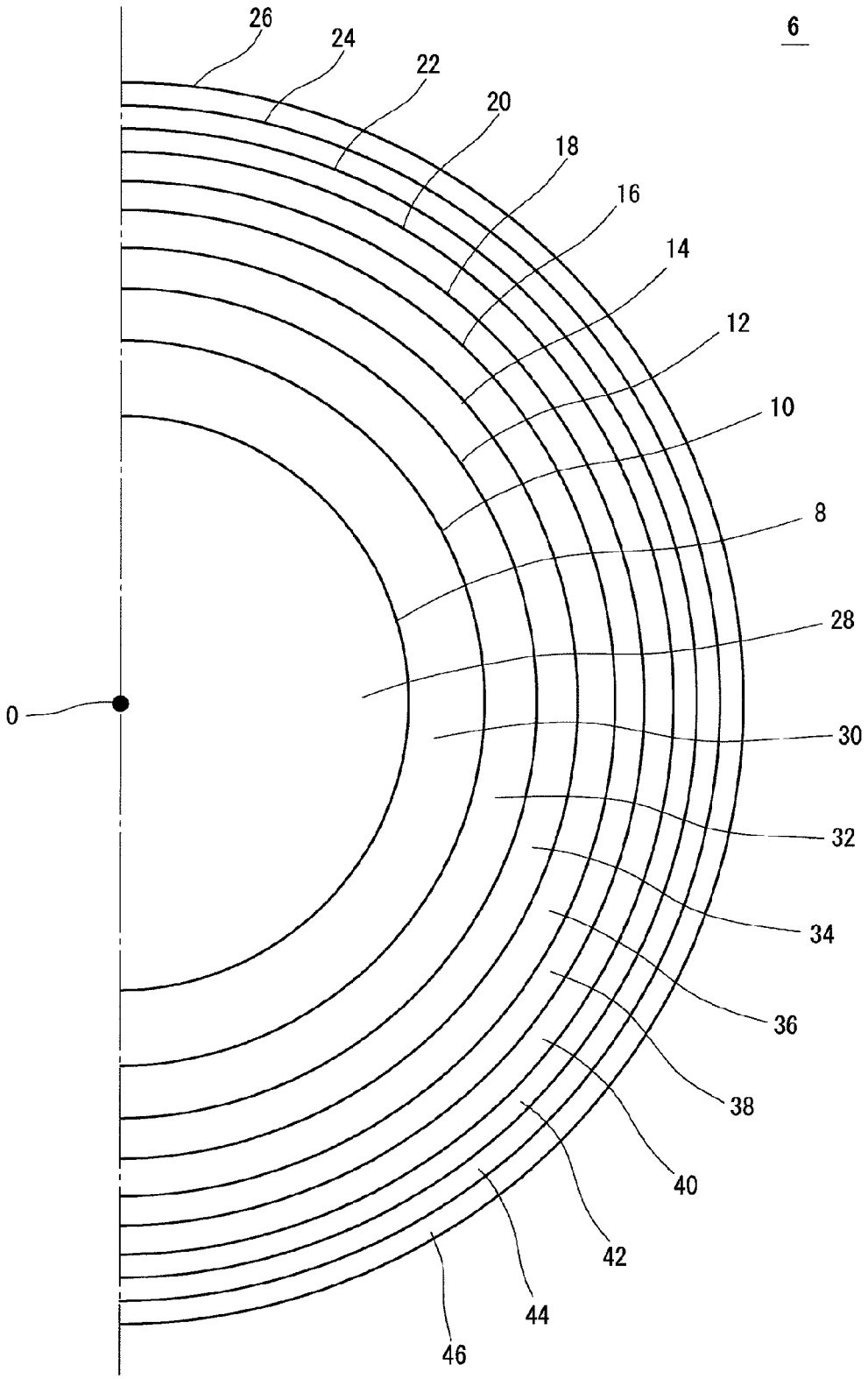
FIG. 2 is a diagram for explaining a method of creating a model used for simulation of the golf ball in FIG. 1.

Hereinafter, a method of obtaining the model 6 will be described with reference to FIG. 2. FIG. 2 shows half of a cross section of the model 6 that has been cut along a plane passing through the center O of the model 6. In this method, a first sphere 8, a second sphere 10, a third sphere 12, a fourth sphere 14, a fifth sphere 16, a sixth sphere 18, a seventh sphere 20, an eighth sphere 22, a ninth sphere 24, and a tenth sphere 26 are assumed. The first sphere 8, the second sphere 10, the third sphere 12, the fourth sphere 14, the fifth sphere 16, the sixth sphere 18, the seventh sphere 20, the eighth sphere 22, the ninth sphere 24, and the tenth sphere 26 are concentric with each other.

The radius of the first sphere 8 is 9.91 mm. The radius of the second sphere 10 is 12.49 mm. The radius of the third sphere 12 is 14.29 mm. The radius of the fourth sphere 14 is 15.73 mm. The radius of the fifth sphere 16 is 16.95 mm. The radius of the sixth sphere 18 is 18.01 mm. The radius of the seventh sphere 20 is 18.96 mm. The radius of the eighth sphere 22 is 19.82 mm. The radius of the ninth sphere 24 is 20.61 mm. The radius of the tenth sphere 26 is 21.35 mm. The radius of the tenth sphere 26 is equal to the radius of the golf ball 2.

The first sphere 8 is also a first layer 28. A portion of the second sphere 10 excluding the first sphere 8 is a second layer 30. A portion of the third sphere 12 excluding the second sphere 10 is a third layer 32. A portion of the fourth sphere 14 excluding the third sphere 12 is a fourth layer 34. A portion of the fifth sphere 16 excluding the fourth sphere 14 is a fifth layer 36. A portion of the sixth sphere 18 excluding the fifth sphere 16 is a sixth layer 38. A portion of the seventh sphere 20 excluding the sixth sphere 18 is a seventh layer 40. A portion of the eighth sphere 22 excluding the seventh sphere 20 is an eighth layer 42. A portion of the ninth sphere 24 excluding the eighth sphere 22 is a ninth layer 44. A portion of the tenth sphere 26 excluding the ninth sphere 24 is a tenth layer 46.

Each of the second layer 30, the third layer 32, the fourth layer 34, the fifth layer 36, the sixth layer 38, the seventh layer 40, the eighth layer 42, the ninth layer 44, and the tenth layer 46 has a shell shape. The volume of each of the first layer 28, the second layer 30, the third layer 32, the fourth layer 34, the fifth layer 36, the sixth layer 38, the seventh layer 40, the eighth layer 42, the ninth layer 44, and the tenth layer 46 is 4076.5 $mm^3$.

Figure 3:
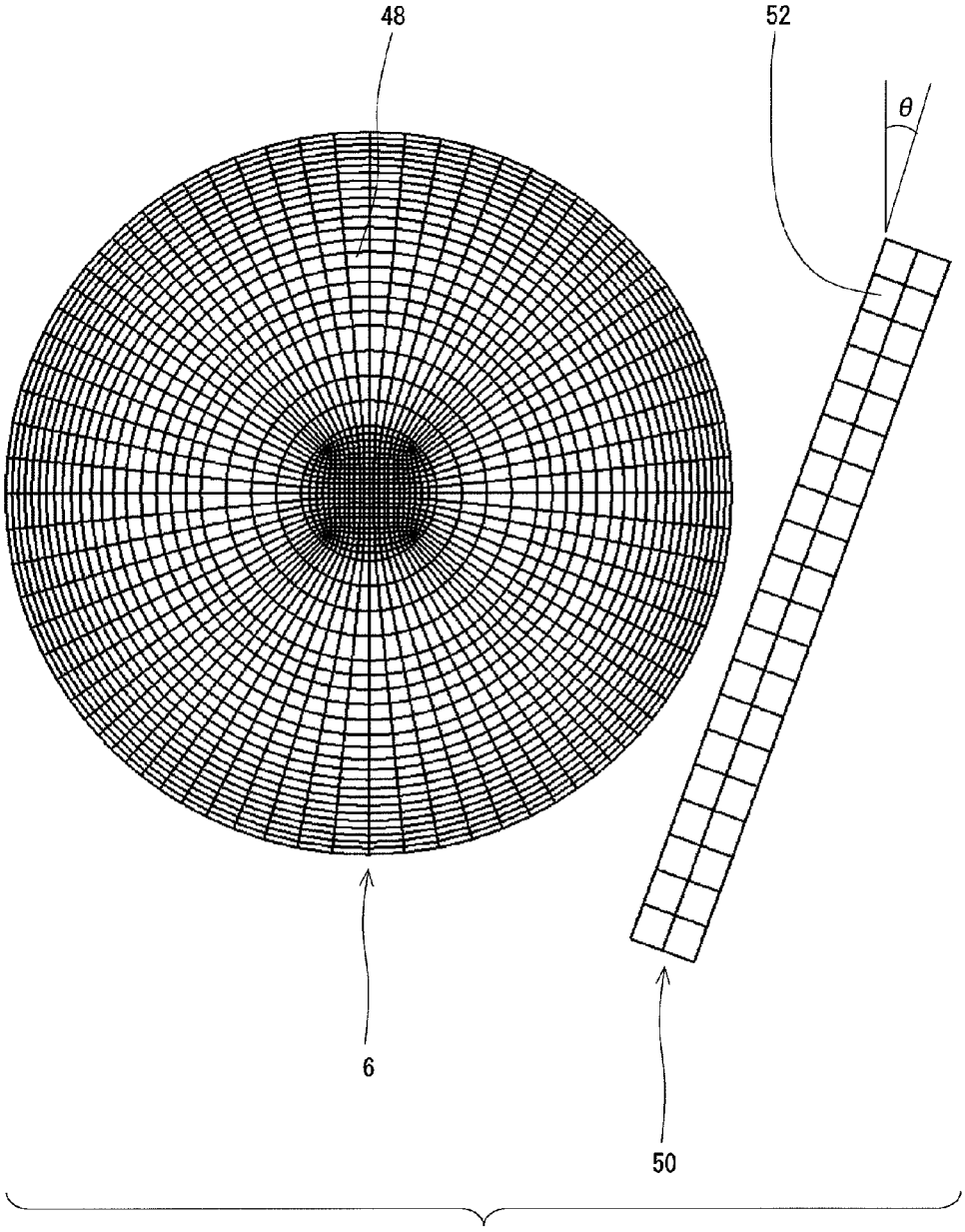
FIG. 3 is a diagram of the model of the golf ball in FIG. 1 with a head model of a golf club.

Each layer shown in FIG. 2 is divided into a large number of elements by a mesh. The model 6 obtained as a result of the division is shown in FIG. 3. The model 6 has elements 48 that are hexahedrons. The division is performed such that in each layer, two or more elements 48 are aligned in the radial direction.

In the simulation, a density is set for each layer. In the present embodiment, the density of any one of the layers is set to 1.673 $g/cm^3$, and the densities of the other nine layers are set to 1.053 $g/cm^3$. In other words, the weight of any one of the layers is set to 6.820 g, and the weights of the other nine layers are set to 4.293 g. The weight of the model 6 is 45.45 g.

In the simulation, in addition to density, it is necessary to set conditions of the model 6 such as hardness distribution and the like. In the present embodiment, a two-piece golf ball composed of a core and a cover is assumed. The ninth sphere 24 is assumed as the core, and the tenth layer 46 is assumed as the cover. The elastic modulus of the core is assumed to be 60 MPa. The Poisson's ratio of the core is assumed to be 0.463. The elastic modulus of the cover is assumed to be 462 MPa. The Poisson's ratio of the cover is assumed to be 0.300. The hardness distribution of the core is assumed to be flat. Various materials that meet these conditions can be used.

FIG. 3 also shows a head model 50 of a golf club. The head model 50 has a plate shape. The size of the head model 50 is 44 mm×44 mm×4 mm. The head model 50 is assumed as a rigid body. The weight of the head model 50 is assumed to be 255.5 g. The head model 50 also has a large number of elements 52. Each element 52 is a hexahedron.

The model 6 of the golf ball 2 and the head model 50 are caused to collide against each other, and the behavior of the model 6 of the golf ball 2 is simulated. The head model 50 is caused to collide against the stationary model 6 of the golf ball 2 at a speed of 40 m/s. The model 6 is caused to collide against the sweet spot of the head model 50. The coefficient of friction between the golf ball 2 and the golf club head is set to 0.30. The coefficient of static friction and the coefficient of dynamic friction therebetween are set to be the same. For the simulation, "LS-DYNA" is used.

A spin rate of the model 6 of the golf ball 2 when the loft angle θ of the head model 50 is assumed to be 20° is calculated. This loft angle θ corresponds to the loft angle of a long iron. A spin rate of the model 6 of the golf ball 2 when the loft angle θ of the head model 50 is assumed to be 56° is calculated. This loft angle θ corresponds to the loft angle of a short iron. The results are shown in Tables 1 and 2 below and FIGS. 4 and 5.

TABLE 1

Results of Simulation

Figure 4:
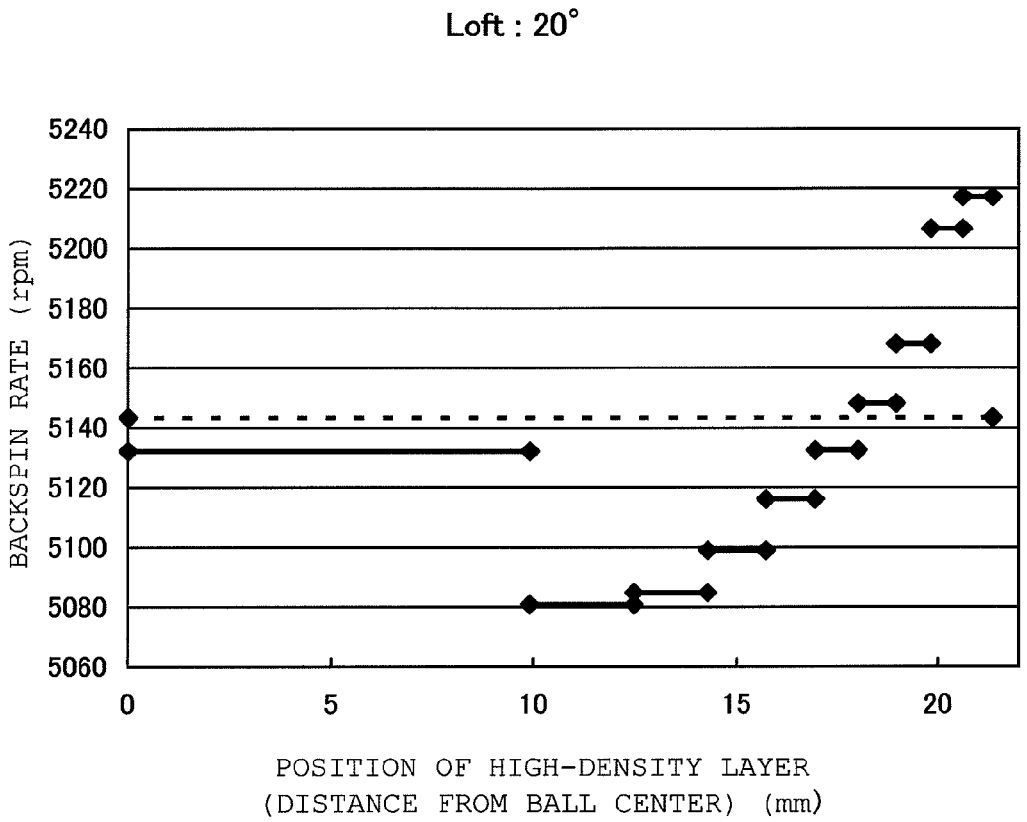
FIG. 4 is a graph showing a result of the simulation.
Figure 5:
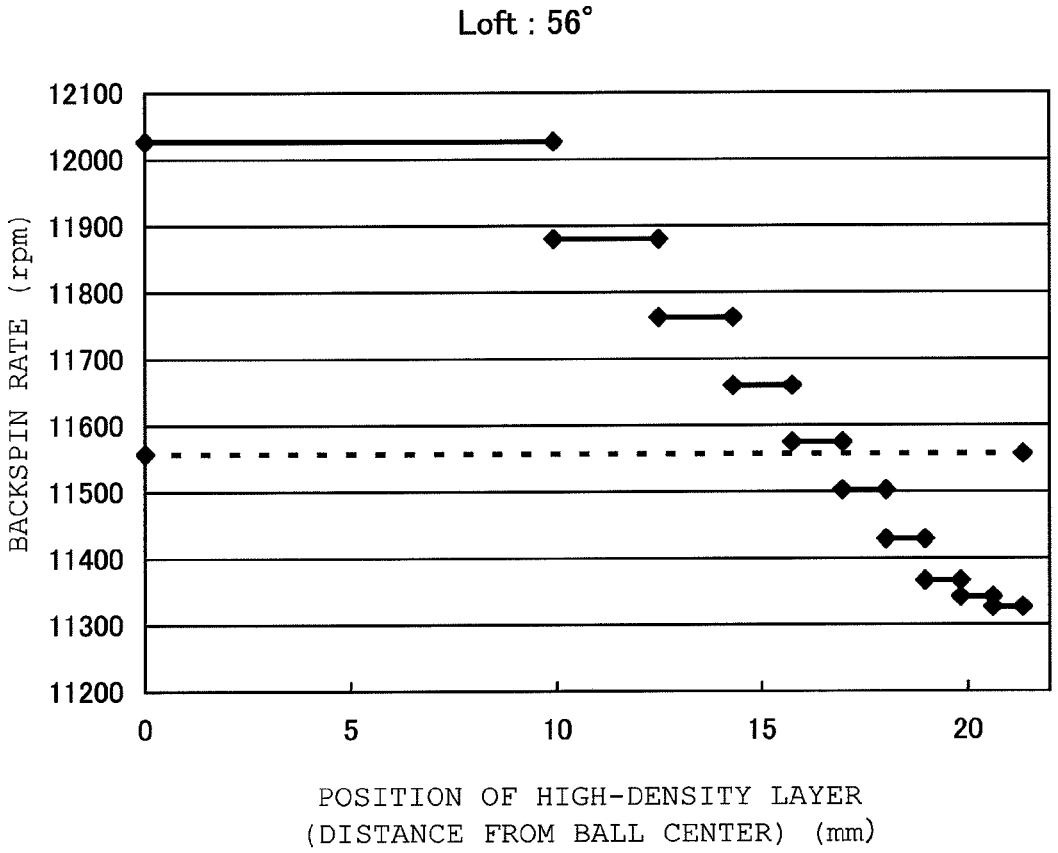
FIG. 5 is a graph showing a result of the simulation.

| | | Ex. 1 | Ex. 2 | Ex. 3 | Ex. 4 | Ex. 5 | Ex. 6 |
|---|---|---|---|---|---|---|---|
| Density ($g/cm^3$) | First layer | 1.673 | 1.053 | 1.053 | 1.053 | 1.053 | 1.053 |
| | Second layer | 1.053 | 1.673 | 1.053 | 1.053 | 1.053 | 1.053 |
| | Third layer | 1.053 | 1.053 | 1.673 | 1.053 | 1.053 | 1.053 |
| | Fourth layer | 1.053 | 1.053 | 1.053 | 1.673 | 1.053 | 1.053 |
| | Fifth layer | 1.053 | 1.053 | 1.053 | 1.053 | 1.673 | 1.053 |
| | Sixth layer | 1.053 | 1.053 | 1.053 | 1.053 | 1.053 | 1.673 |
| | Seventh layer | 1.053 | 1.053 | 1.053 | 1.053 | 1.053 | 1.053 |
| | Eighth layer | 1.053 | 1.053 | 1.053 | 1.053 | 1.053 | 1.053 |
| | Ninth layer | 1.053 | 1.053 | 1.053 | 1.053 | 1.053 | 1.053 |
| | Tenth layer | 1.053 | 1.053 | 1.053 | 1.053 | 1.053 | 1.053 |
| Ratio Px (%) | | 23 | 52 | 63 | 70 | 77 | 82 |
| Spin (rpm) | Loft 20° | 5132 FIG. 4 | 5081 FIG. 4 | 5085 FIG. 4 | 5099 FIG. 4 | 5116 FIG. 4 | 5132 FIG. 4 |
| | Loft 56° | 12027 FIG. 5 | 11880 FIG. 5 | 11762 FIG. 5 | 11660 FIG. 5 | 11575 FIG. 5 | 11503 FIG. 5 |

TABLE 2

Results of Simulation

| | | Com. Ex. 1 | Com. Ex. 2 | Com. Ex. 3 | Com. Ex. 4 | Com. Ex. 5 | Com. Ex. 6 |
|---|---|---|---|---|---|---|---|
| Density ($g/cm^3$) | First layer | 1.053 | 1.053 | 1.053 | 1.053 | 1.112 | 1.115 |
| | Second layer | 1.053 | 1.053 | 1.053 | 1.053 | 1.112 | 1.115 |
| | Third layer | 1.053 | 1.053 | 1.053 | 1.053 | 1.112 | 1.115 |
| | Fourth layer | 1.053 | 1.053 | 1.053 | 1.053 | 1.112 | 1.115 |
| | Fifth layer | 1.053 | 1.053 | 1.053 | 1.053 | 1.112 | 1.115 |
| | Sixth layer | 1.053 | 1.053 | 1.053 | 1.053 | 1.112 | 1.115 |
| | Seventh layer | 1.673 | 1.053 | 1.053 | 1.053 | 1.112 | 1.115 |
| | Eighth layer | 1.053 | 1.673 | 1.053 | 1.053 | 1.112 | 1.115 |
| | Ninth layer | 1.053 | 1.053 | 1.673 | 1.053 | 1.112 | 1.115 |
| | Tenth layer | 1.053 | 1.053 | 1.053 | 1.673 | 1.053 | 1.115 |
| Ratio Px (%) | | 87 | 91 | 95 | 98 | 71 | — |
| Spin (rpm) | Loft 20° | 5148 FIG. 4 | 5168 FIG. 4 | 5206 FIG. 4 | 5217 FIG. 4 | 5131 — | 5143 FIG. 4 |
| | Loft 56° | 11429 FIG. 5 | 11366 FIG. 5 | 11342 FIG. 5 | 11327 FIG. 5 | 11601 — | 11557 FIG. 5 |

In Examples 1 to 6 in Table 1, any one of six layers including the first layer 28 to the sixth layer 38 is a layer having a high weight. In Comparative Examples 1 to 4 in Table 2, any one of four layers including the seventh layer 40 to the tenth layer 46 is a layer having a high weight.

In Comparative Example 5 in Table 2, nine layers including the first layer 28 to the ninth layer 44 are layers having high weights. In Comparative Example 6 in Table 2, the densities of the first layer 28 to the tenth layer 46 are assumed to be uniform. In FIGS. 4 and 5, a calculation result of Comparative Example 6 is indicated by dotted lines.

As is obvious from Tables 1 and 2 and FIGS. 4 and 5, in the golf ball 2 of each Example, the spin rate when the loft angle is 20° is low. When the golf ball 2 of each Example is hit with a long iron, excellent flight performance is achieved. In the golf ball 2 of each Example, the spin rate when the loft angle is 56° is high. When the golf ball 2 of each Example is hit with a short iron, excellent controllability is achieved.

From the evaluation results, it is recognized that it is preferred that any one of the six layers including the first layer 28 to the sixth layer 38 is a layer having the highest weight. It is particularly preferred that the layer having the highest weight is the second layer 30, the third layer 32, or the fourth layer 34.

A plurality of models are assumed in which two consecutive layers among ten layers including the first layer 28 to the tenth layer 46 are layers having the highest weight. The results of the simulation conducted on the basis of these models are shown in Tables 3 and 4 below and FIGS. 6 and 7.

TABLE 3

Figure 6:
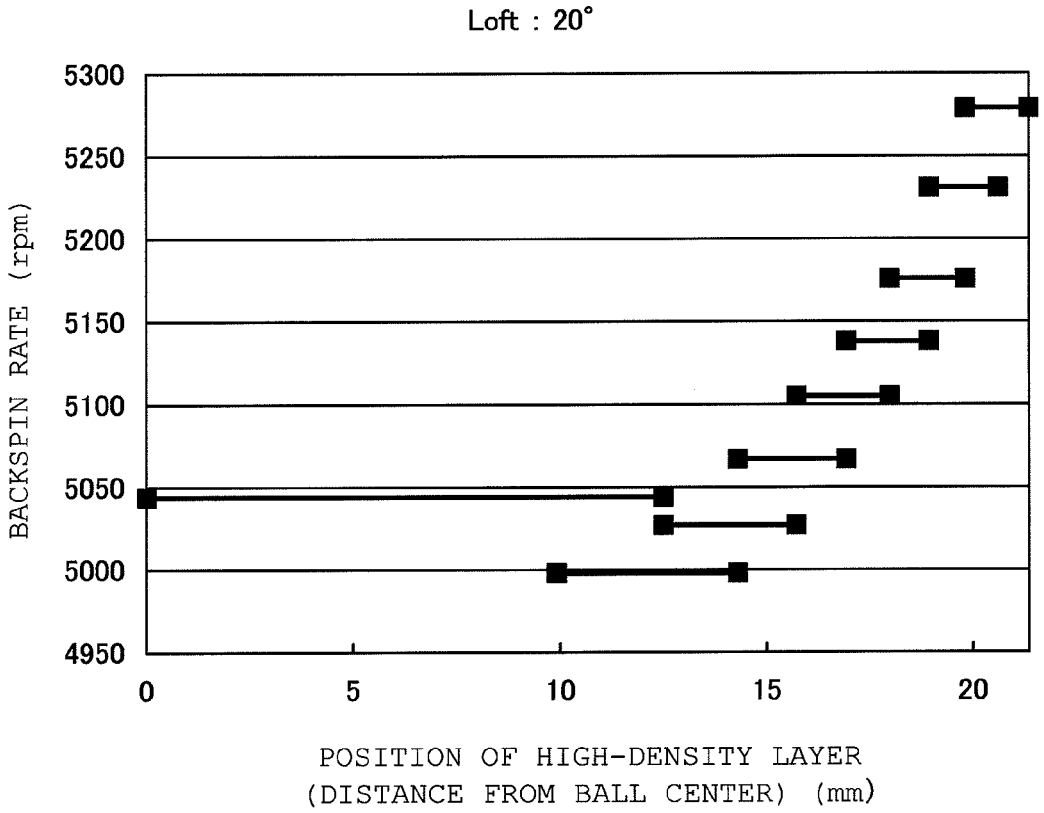
FIG. 6 is a graph showing a result of the simulation.
Figure 7:
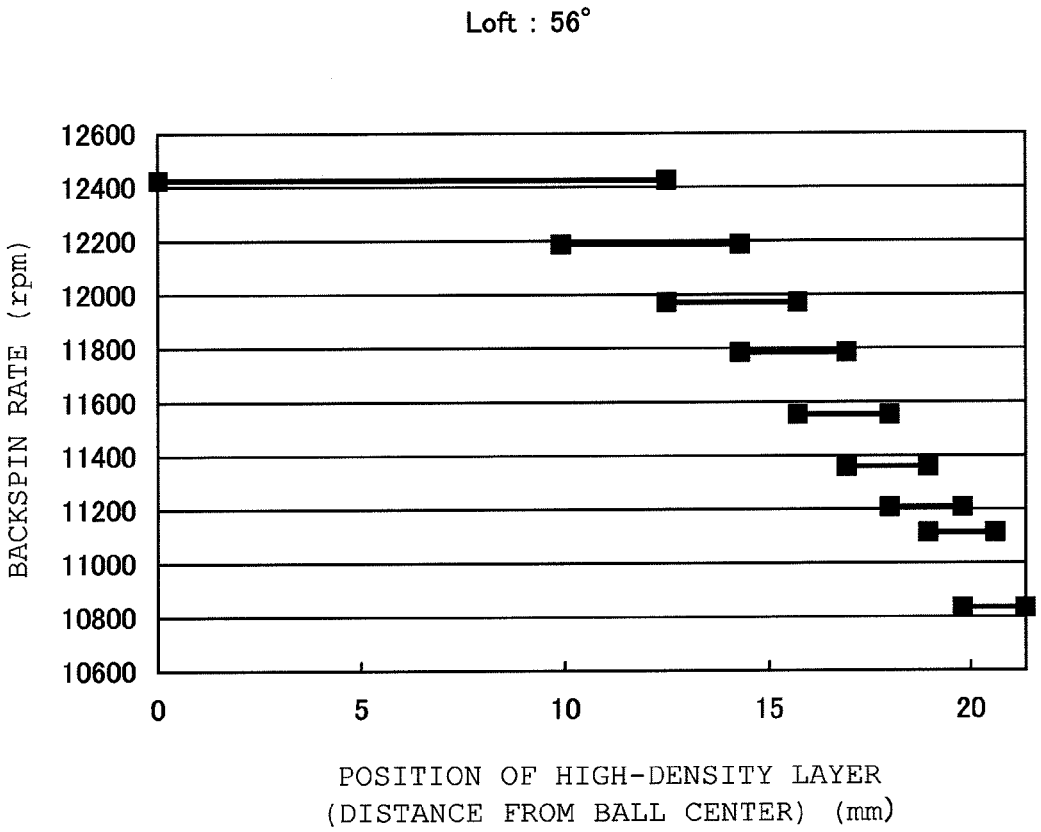
FIG. 7 is a graph showing a result of the simulation.

| Results of Simulation | | | | | | |
|---|---|---|---|---|---|---|
| | | Ex. 7 | Ex. 8 | Ex. 9 | Ex. 10 | Ex. 11 |
| Density ($g/cm^3$) | First layer | 1.673 | 0.967 | 0.967 | 0.967 | 0.967 |
| | Second layer | 1.673 | 1.673 | 0.967 | 0.967 | 0.967 |
| | Third layer | 0.967 | 1.673 | 1.673 | 0.967 | 0.967 |
| | Fourth layer | 0.967 | 0.967 | 1.673 | 1.673 | 0.967 |
| | Fifth layer | 0.967 | 0.967 | 0.967 | 1.673 | 1.673 |
| | Sixth layer | 0.967 | 0.967 | 0.967 | 0.967 | 1.673 |
| | Seventh layer | 0.967 | 0.967 | 0.967 | 0.967 | 0.967 |
| | Eighth layer | 0.967 | 0.967 | 0.967 | 0.967 | 0.967 |
| | Ninth layer | 0.967 | 0.967 | 0.967 | 0.967 | 0.967 |
| | Tenth layer | 0.967 | 0.967 | 0.967 | 0.967 | 0.967 |
| Ratio Px (%) | | 38 | 58 | 67 | 73 | 79 |
| Spin (rpm) | Loft 20° | 5044 FIG. 6 | 4998 FIG. 6 | 5027 FIG. 6 | 5067 FIG. 6 | 5105 FIG. 6 |
| | Loft 56° | 12425 FIG. 7 | 12187 FIG. 7 | 11971 FIG. 7 | 11785 FIG. 7 | 11553 FIG. 7 |

TABLE 4

| Results of Simulation | | | | | |
|---|---|---|---|---|---|
| | | Com. Ex. 7 | Com. Ex. 8 | Com. Ex. 9 | Com. Ex. 10 |
| Density ($g/cm^3$) | First layer | 0.967 | 0.967 | 0.967 | 0.967 |
| | Second layer | 0.967 | 0.967 | 0.967 | 0.967 |
| | Third layer | 0.967 | 0.967 | 0.967 | 0.967 |
| | Fourth layer | 0.967 | 0.967 | 0.967 | 0.967 |
| | Fifth layer | 0.967 | 0.967 | 0.967 | 0.967 |
| | Sixth layer | 1.673 | 0.967 | 0.967 | 0.967 |
| | Seventh layer | 1.673 | 1.673 | 0.967 | 0.967 |
| | Eighth layer | 0.967 | 1.673 | 1.673 | 0.967 |
| | Ninth layer | 0.967 | 0.967 | 1.673 | 1.673 |
| | Tenth layer | 0.967 | 0.967 | 0.967 | 1.673 |

TABLE 4-continued

| Results of Simulation | | | | | |
|---|---|---|---|---|---|
| | | Com. Ex. 7 | Com. Ex. 8 | Com. Ex. 9 | Com. Ex. 10 |
| Ratio Px (%) | | 84 | 89 | 93 | 96 |
| Spin (rpm) | Loft 20° | 5138 FIG. 6 | 5176 FIG. 6 | 5231 FIG. 6 | 5279 FIG. 6 |
| | Loft 56° | 11359 FIG. 7 | 11209 FIG. 7 | 11114 FIG. 7 | 10834 FIG. 7 |

From the evaluation results, it is recognized that it is preferred that any one of six layers including the first layer 28 to the sixth layer 38 is a layer having the highest weight.

Figure 8:
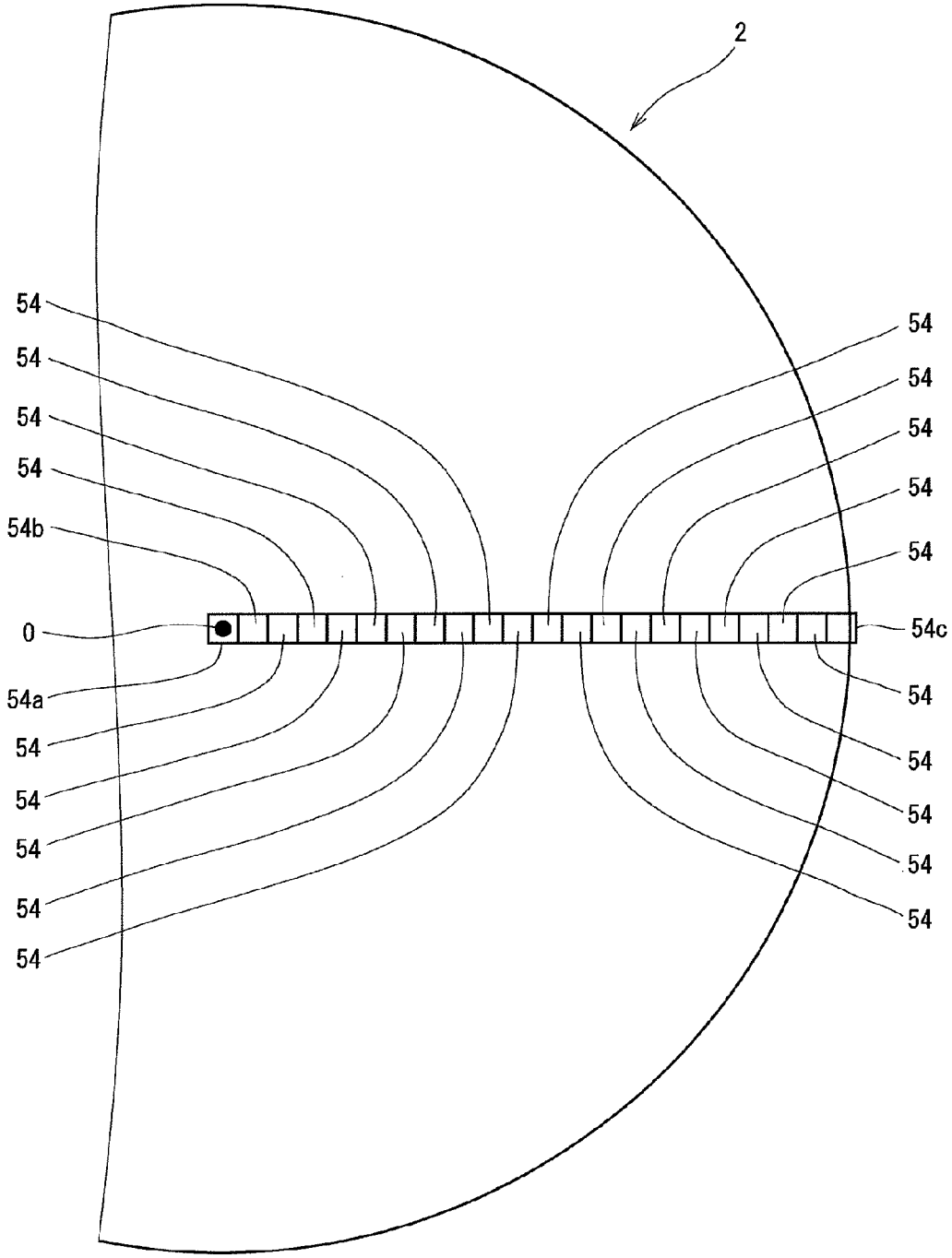
FIG. 8 is a diagram for explaining a method of determining a point at which the density in the golf ball in FIG. 1 is the highest.

FIG. 8 is a diagram for explaining a method of determining a point at which the density in the golf ball 2 in FIG. 1 is the highest. In this method, a large number of solids are cut out from the golf ball 2. First, a regular hexahedron 54*a* whose center coincides with the center O of the golf ball 2 is cut out. Each side of the regular hexahedron 54*a* has a length of 1 mm. Another regular hexahedron 54*b* is cut out which is located radially outward of the regular hexahedron 54*a*, which shares one face with the regular hexahedron 54*a*, and of which each side has a length of 1 mm. Subsequently, regular hexahedrons 54 of which each side has a length of 1 mm are sequentially cut out along the radius direction. By measuring the volume and the weight of each regular hexahedron 54, the density of the regular hexahedron 54 can be calculated. A regular hexahedron 54*c* that is assumed on the outermost side includes a space. The volume and the weight of a portion of the regular hexahedron 54*c* excluding the space is measured to calculate the density of the portion.

One regular hexahedron 54 can be present so as to extend across two or more layers. For example, a regular hexahedron 54 can be present so as to extend across the core and the mid layer. In addition, a regular hexahedron 54 can be present so as to extend across the mid layer and the cover. In this case, the regular hexahedron 54 is divided into a plurality of solids by the interface between the layers. The volume and the weight of each solid obtained by the division are measured to calculate the density of each solid.

The ratio Px of the distance X between the center, in the radius direction, of the solid having the highest density and the central point of the golf ball 2 with respect to the radius of the golf ball 2 is preferably equal to or less than 85%. When the golf ball 2 in which the ratio Px is equal to or less than 85% is hit with a long iron, spin is suppressed and a large flight distance is obtained. When the golf ball 2 in which the ratio Px is equal to or less than 85% is hit with a short iron, desired controllability is achieved by a high spin rate. In these respects, the ratio Px is more preferably equal to or less than 80%. Particularly preferably, the ratio Px is equal to or greater than 25% but equal to or less than 75%.

When there are two or more solids having the highest density, the distance X of each solid is calculated and the average thereof is obtained. The ratio Px is calculated on the basis of the average.

The golf ball according to the present invention can be used for playing golf on golf courses and practicing at driving ranges. The above descriptions are merely for illustrative examples, and various modifications can be made without departing from the principles of the present invention.

What is claimed is:

1. A golf ball having a non-uniform density, wherein the golf ball is divided into 10 layers, each of said layers having volumes which are the same and which are concentric with each other, and the layer having the highest weight is one or more layers among layers including the first layer from the central point of the golf ball to the sixth layer from the central point.

2. The golf ball according to claim 1, wherein the layer having the highest weight is any one layer among the layers including the first layer from the central point of the golf ball to the sixth layer from the central point.

3. The golf ball according to claim 2, wherein the layer having the highest weight is any one layer among layers including the first layer from the central point of the golf ball to the fifth layer from the central point.

4. The golf ball according to claim 1, wherein the layer having the highest weight is one or more layers among layers including the second layer from the central point of the golf ball to the fourth layer from the central point.

5. A golf ball having a non-uniform density, wherein the golf ball is divided into 9 layers, each of said layers having volumes which are the same and which are concentric with each other, and the layer having the highest weight is one or more layers among layers including the first layer from the central point of the golf ball to the fifth layer from the central point.

6. The golf ball according to claim 5, wherein the layer having the highest weight is any one layer among the layers including the first layer from the central point of the golf ball to the fifth layer from the central point.

7. The golf ball according to claim 6, wherein the layer having the highest weight is any one layer among layers including the first layer from the central point of the golf ball to the fourth layer from the central point.

8. The golf ball according to claim 5, wherein the layer having the highest weight is one or more layers among layers including the second layer from the central point of the golf ball to the fourth layer from the central point.

* * * * *